US005575148A

United States Patent [19]

Hirata et al.

[11] Patent Number: 5,575,148

[45] Date of Patent: Nov. 19, 1996

[54] HYDRAULIC PUMP CONTROL SYSTEM

[75] Inventors: Toichi Hirata, Ushiku; Genroku Sugiyama, Ibaraki-ken; Hiroshi Watanabe, Ushiku; Shigehiro Yoshinaga, Ibaraki-ken, all of Japan

[73] Assignee: Hitachi Construction Machinery Co., Ltd., Tokyo, Japan

[21] Appl. No.: 454,270

[22] PCT Filed: Nov. 30, 1994

[86] PCT No.: PCT/JP94/02008

§ 371 Date: Jun. 7, 1995

§ 102(e) Date: Jun. 7, 1995

[87] PCT Pub. No.: WO95/15441

PCT Pub. Date: Jun. 8, 1995

[30] Foreign Application Priority Data

Nov. 30, 1993 [JP] Japan ..... 5-300052

[51] Int. Cl.[6] ..... F16D 31/02

[52] U.S. Cl. ..... 60/445; 60/452

[58] Field of Search ..... 60/445, 452

[56] References Cited

U.S. PATENT DOCUMENTS

| | | | |
|---|---|---|---|
| 3,871,178 | 3/1975 | Tominaga | 60/445 |
| 4,479,349 | 10/1984 | Westveer | 60/445 |
| 5,046,309 | 9/1991 | Yoshino | 60/452 |
| 5,295,795 | 3/1994 | Yasuda et al. | 60/445 |
| 5,421,155 | 6/1995 | Hirata et al. | 60/452 |
| 5,447,027 | 9/1995 | Ishikawa et al. | 60/452 |

FOREIGN PATENT DOCUMENTS

| | | | |
|---|---|---|---|
| 62-98003 | 5/1987 | Japan . | |
| 63-162982 | 10/1988 | Japan . | |
| 1-25921 | 5/1989 | Japan . | |
| 1-193401 | 8/1989 | Japan . | |
| 81/00742 | 3/1981 | WIPO | 60/445 |

*Primary Examiner*—F. Daniel Lopez

*Attorney, Agent, or Firm*—Fay, Sharpe, Beall, Fagan, Minnich & McKee

[57] ABSTRACT

A controller 24 includes function generators 151, 152. The function generator 151 is set to have such a characteristic that as the detected value $P_N$ of a negative control pressure from a pressure sensor 21 is reduced, a first target tilting amount $\theta_N$ increases from a minimum value to a maximum value, and the function generator 152 is set to have such a characteristic that as the detected value $P_B$ of a control input (pilot pressure) for driving a boom cylinder 6 is increased, a second target tilting amount $\theta_B$ increases from a predetermined minimum value to the same maximum value as the above maximum value. Minimum one of the two target tilting amounts from both the function generators is selected, and a proportional solenoid valve 25 is driven based on the selected minimum tilting amount. This makes it possible to surely suppress an unwanted speed increase of a specific hydraulic actuator other than a boom cylinder, such as a swing motor 9, that would be caused when the tilting amount is controlled based on only the negative control pressure.

9 Claims, 7 Drawing Sheets

HYDRAULIC PUMP CONTROL SYSTEM

TECHNICAL FIELD

The present invention relates to a hydraulic pump control system for use with a hydraulic drive system of hydraulic working machines such as hydraulic excavators, and more particularly to a hydraulic pump control system which carries out flow rate control of a hydraulic pump for driving a plurality of hydraulic actuators.

BACKGROUND ART

A hydraulic working machine such as a hydraulic excavator is equipped with a hydraulic drive system including a plurality of hydraulic actuators, a hydraulic pump, etc., and conducts various required operations while driving the plurality of hydraulic actuators by the hydraulic pump. The hydraulic drive system generally used comprises a variable displacement hydraulic pump, a plurality of hydraulic actuators driven by the hydraulic pump, a plurality of flow control valves of the center bypass type for controlling the driving of the hydraulic actuators, and a center bypass line connecting the center bypasses of the flow control valves in series. As disclosed in JP, A, 125921, such a hydraulic drive system also comprises a flow resisting mean, e.g., a fixed throttle, disposed downstream of the center bypass line for generating a negative control pressure in the center bypass line, a pressure sensor for detecting the negative control pressure generated in the center bypass line, a controller for calculating, based on the detected value of the pressure sensor, the target displacement volume of the hydraulic pump (i.e., the tilting amount of a swash plate) in accordance with a preset characteristic and then outputting an electric signal corresponding to the calculated value, and a regulator driven by the electric signal for controlling the displacement volume of the hydraulic pump.

The center bypass of each of the flow control valves is fully opened when the associated flow control valve is in a neutral position, and is restricted gradually as the valve is shifted from the neutral position. When all the flow control valves are in neutral positions, i.e., any of the hydraulic actuators is not driven, a hydraulic fluid delivered from the hydraulic pump is passed at a full flow rate through the center bypass line, and the negative control pressure detected by the pressure sensor is maximized. The controller calculates the minimum target displacement volume in accordance with the preset characteristic, and the hydraulic pump is controlled so that the displacement volume (i.e., the delivery rate) thereof is minimized. In an attempt to drive one hydraulic actuator, for example, when the corresponding flow control valve is operated, the center bypass of the operated valve is restricted to reduce the flow rate passing through the center bypass line, and the negative control pressure detected by the pressure sensor is also reduced. Therefore, the target displacement volume calculated by the controller is increased in accordance with the preset characteristic, whereupon the hydraulic pump increases the target displacement volume and delivers the hydraulic fluid at a flow rate enough to drive -the hydraulic actuator.

DISCLOSURE OF THE INVENTION

In the conventional hydraulic pump control system described above, irrespective of the type of hydraulic actuator to be driven, the displacement volume of the hydraulic pump is uniquely determined by the controller in accordance with the preset characteristic for the negative control pressure generated depending on the amount by which any of the hydraulic actuator is operated, i.e., the control input for operating it. However, preferable driving speeds of the hydraulic actuators are different one by one, and control levers are mostly manipulated over their full strokes in usual operations.

Taking a hydraulic excavator as an example, preferable driving speeds of the hydraulic actuators are as follows. It is desired for a boom cylinder to have a large maximum driving speed to achieve high working efficiency. Since a swing motor is of great inertia and poses a difficulty in precisely stopping the same at the intended position, it desirably has a small maximum driving speed. Since a bucket cylinder is of small size and frequently strikes against the stroke end when driven, it desirably has a small maximum driving speed in order to prevent shocks, deterioration in durability, useless pressure relief, etc. Further, an arm cylinder is of smaller size than the boom cylinder and suffers the similar problem to that of the bucket cylinder, but it is closely related to operation of the boom cylinder in many cases during the work. Therefore, the arm cylinder desirably has a large maximum driving speed as with the boom cylinder.

For the purpose of efficiently carrying out the work, the characteristic determined by the controller is usually selected such that the boom cylinder, for example, can be driven at a satisfactory speed. Accordingly, when a swing control lever or a bucket control lever is manipulated over its full stroke, the swing motor or the bucket cylinder is driven at an excessive speed, resulting in drawbacks below. For the swing motor, a difficulty is caused in precisely stopping the motor at the intended position, durability of the motor itself and speed reducing gears is reduced, and noise is increased. For the bucket cylinder, shocks and useless pressure relief are caused whenever it strikes against the stroke end, and hence durability of the cylinder is deteriorated.

Those problems are encountered not only in hydraulic excavators taken above as an example, but also in various hydraulic working machines, other than hydraulic excavators, which include a plurality of hydraulic actuators.

An object of the present invention is to solve the above-mentioned problems in the prior art, and to provide a hydraulic pump control system which can suppress unwanted speed increases of hydraulic actuators.

To achieve the above object, according to the present invention, there is provided a hydraulic pump control system for use with a hydraulic drive system comprising a variable displacement hydraulic pump, a plurality of hydraulic actuators driven by the hydraulic pump, a plurality of flow control valves of the center bypass type for controlling the driving of the hydraulic actuators, and a center bypass line connecting the center bypasses of the flow control valves in series, the hydraulic pump control system controlling a displacement volume of the hydraulic pump by using a negative control pressure generated by flow resisting means which is disposed downstream of the center bypass line, the hydraulic pump control system comprising pressure detecting means for detecting the negative control pressure generated in the center bypass line, first target displacement volume calculating means for calculating, based on a detected value of the pressure detecting means, a first target displacement volume of the hydraulic pump in accordance with a preset first characteristic, first control input detecting means for detecting a control input for operating at least one of the plurality of hydraulic actuators, maximum target displacement volume limiting means for limiting, depending on the detected value of the first control input detecting means, a maximum value of the first target displacement volume calculated by the first target displacement volume calculating means based on the detected value of the pressure detecting means, and providing a target displacement volume to be output, and a regulator for controlling the displacement volume of the hydraulic pump in accordance with the target displacement volume to be output.

In the hydraulic pump control system thus arranged, when one or more corresponding control means are manipulated for driving one or more hydraulic actuators, the detected value of the pressure detecting means for detecting the negative control pressure is changed and the first target displacement volume calculating means calculates the first target displacement volume corresponding to the resulting detected value in accordance with the preset first characteristic. At the same time, the first control input detecting means detects the control input for operating the at least one hydraulic actuator, and the maximum target displacement volume limiting means limits, depending on the detected value of the first control input detecting means, the maximum value of the first target displacement volume calculated by the first target displacement volume calculating means and provides the target displacement volume to be output. In this respect, when the hydraulic actuator to be driven is the at least one hydraulic actuator, the detected value of the first control input detecting means is output as a value depending on the control input and the maximum value of the first target displacement volume limited by the maximum target displacement volume limiting means is given as a value corresponding to the resulting detected value. For example, when a control lever is manipulated over its full stroke, the detected value of the first control input detecting means is maximized and the maximum value of the first target displacement volume limited by the maximum target displacement volume limiting means is also maximized. Therefore, the displacement volume of the hydraulic pump is controlled so as to maximize the maximum target displacement volume, making it possible to increase the maximum driving speed of the at least one hydraulic actuator.

On the other hand, when the hydraulic actuator to be driven is other one than the at least one hydraulic actuator, the detected value of the first control input detecting means is 0 and the maximum value of the first target displacement volume is limited by the maximum target displacement volume limiting means so as to be minimized. Then, the first target displacement volume of the thus-minimized maximum value is used as the target displacement volume to be output for controlling the hydraulic pump. It is therefore possible to prevent an unwanted speed increase of the other hydraulic actuator than the at least one hydraulic actuator.

In the above hydraulic pump control system, preferably, the maximum target displacement volume limiting means comprises second target displacement volume calculating means for calculating, based on the detected value of the first control input detecting means, a second target displacement volume of the hydraulic pump in accordance with a preset third characteristic different from the first characteristic, and smaller value selecting means for selecting smaller one of the first and second target displacement volumes as the target displacement volume to be output.

In this case, preferably, the first characteristic is such that the first target displacement volume increases from a predetermined minimum value to a predetermined maximum value as the detected value of the pressure detecting means is reduced, and the second characteristic is such that the second target displacement volume increases from a predetermined minimum value to a predetermined maximum value as the detected value of the first control input detecting means is increased, the predetermined minimum value of the second characteristic being smaller than the predetermined maximum value of the first characteristic. In this connection, it is desired that the predetermined maximum value of the second characteristic is equal to the predetermined maximum value of the first characteristic.

In the above hydraulic pump control system, preferably, the system further comprises second control input detecting means for detecting a control input for operating other one of the plurality of hydraulic actuators or a control input in a different direction from the control input for operating the at least one hydraulic actuator, the maximum target displacement volume limiting means further comprises third target displacement volume calculating means for calculating, based on the detected value of the second control input detecting means, a third target displacement volume of the hydraulic pump in accordance with a preset third characteristic different from both the first and second characteristics, and the smaller value selecting means selects a minimum value of the first, second and third target displacement volumes as the target displacement volume to be output.

In this case, preferably, the third characteristic is such that the third target displacement volume reduces from a predetermined maximum value to a predetermined minimum value as the detected value of the second control input detecting means is increased.

In the above hydraulic pump control system, preferably, the at least one actuator is an actuator of which desired maximum driving speed is relatively large. As one example, the actuator of which desired maximum driving speed is relatively large is a boom cylinder for operating a boom of a hydraulic excavator. Alternatively, the actuator of which desired maximum driving speed is relatively large is an arm cylinder for operating an arm of a hydraulic excavator.

When one or more corresponding control means are manipulated for driving one or more hydraulic actuators, the detected value of negative control pressure detecting means is changed and the tilting amount corresponding to the resulting detected value is extracted in accordance with one preset characteristic. On the other hand, when specific control means is manipulated, the amount by which the specific control means has been manipulated, i.e., the control input from the specific control means, is detected by the control input detecting means and the tilting amount corresponding to the resulting detected value is extracted in accordance with another preset characteristic. All the extracted tilting amounts are compared with one another in minimum value selecting means which outputs a minimum value among them. Regulator driving means drives the regulator in accordance with the selected minimum value for tilting a swash plate of the hydraulic pump. By setting the characteristics appropriately, the speed of a specific hydraulic actuator is suppressed when it is driven solely.

BEST MODE FOR CARRYING OUT THE INVENTION

Embodiments of the present invention will be described below with reference to the drawings. In the embodiments, the present invention is applied to a hydraulic drive system of hydraulic excavators.

Figure 1:
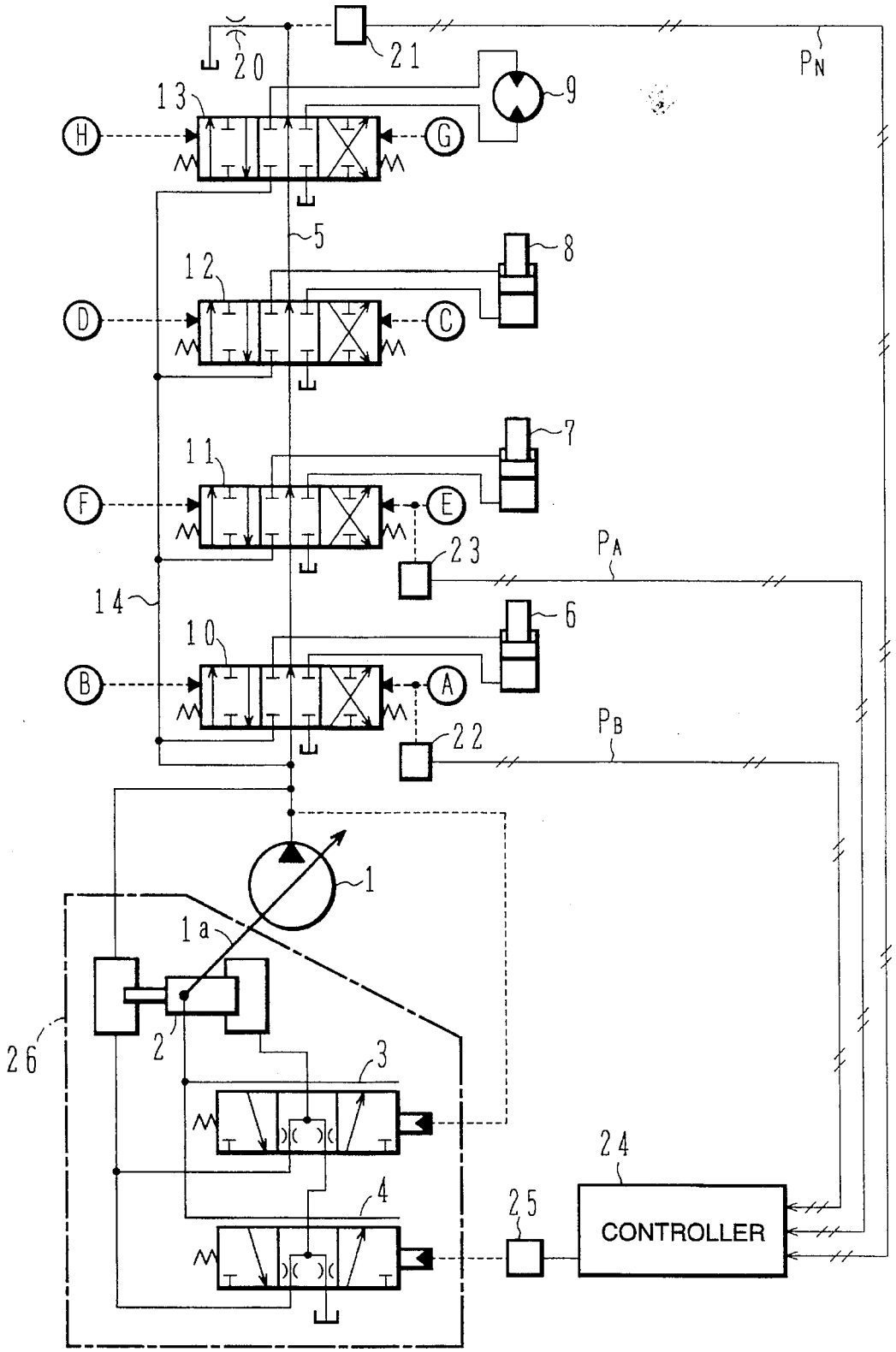
FIG. 1 is a hydraulic circuit diagram of a hydraulic pump control system for a hydraulic drive system according to a first embodiment of the present invention.

In FIG. 1, a hydraulic drive system for carrying out the first embodiment of the present invention comprises a variable displacement hydraulic pump 1 having a displacement volume varying mechanism (hereinafter represented by a swash plate) 1*a*, a plurality of hydraulic actuators driven by the hydraulic pump 1, i.e., a boom cylinder 6, an arm cylinder 7, a bucket cylinder 8 and a swing motor 9, a plurality of flow control valves 10, 11, 12, 13 of the center bypass type for controlling the driving of the hydraulic actuators, and a center bypass line 5 connecting the center bypasses of the flow control valves in series. The center bypass line 5 has an upstream end connected to the hydraulic pump 1 and a downstream end connected to a reservoir. Also, input ports of the flow control valves 10 to 13 are connected to the hydraulic pump 1 in parallel via a bypass line 14.

Figure 2:
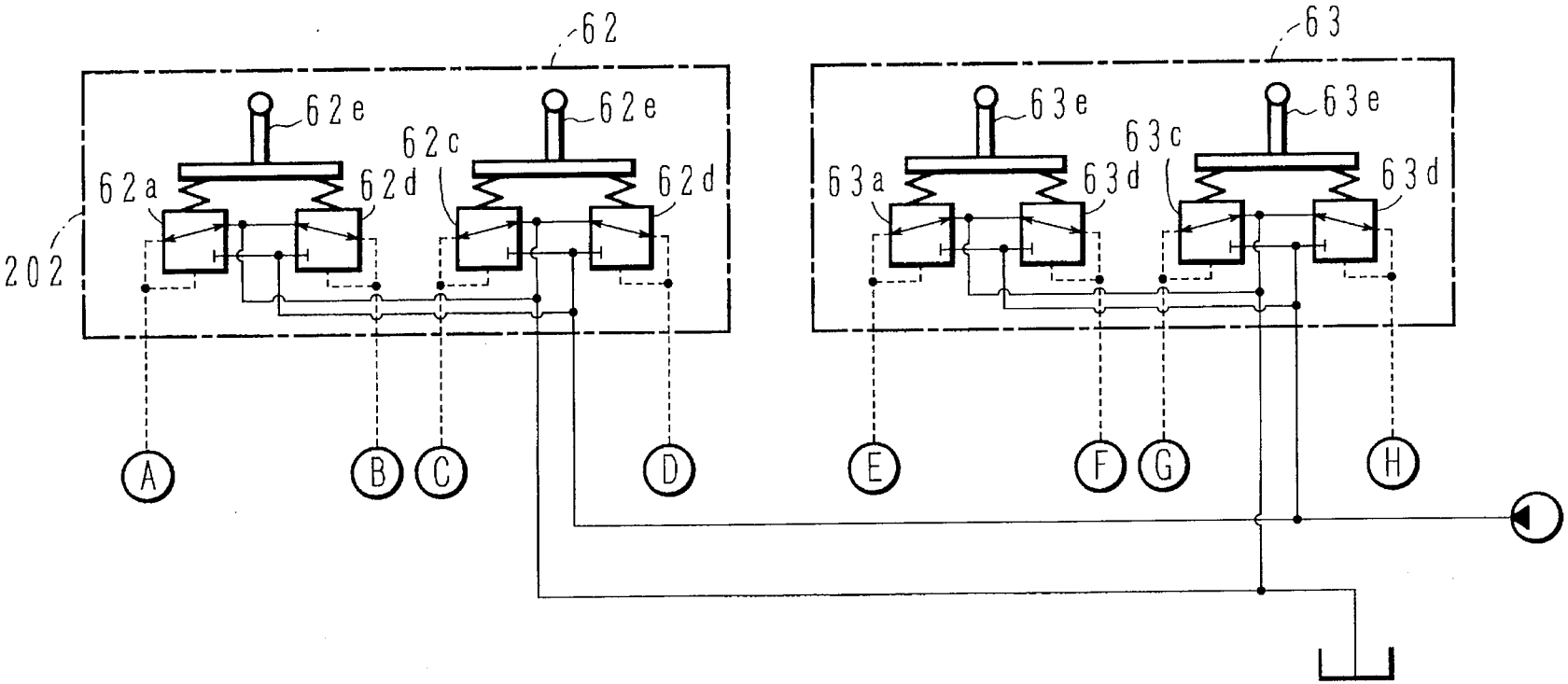
FIG. 2 is a view showing detailed construction of a control lever unit.

The flow control valves 10 to 13 are of hydraulically pilot-operated valves and are operated with pilot pressures A to H output from control lever units 62, 63 shown in FIG. 2. More specifically, the control lever unit 62 comprises boom pilot valves 62*a*, 62*b*, bucket pilot valves 62*c*, 62*d*, and a common control lever 62*e* which can be manipulated in any of four crucial directions for selectively operating those pilot valves. The pilot valves 62*a*; 62*b*; 62*c*, 62*d* are each operated depending on the amount by which the control lever 62*e* is manipulated in corresponding one of the four crucial directions, i.e., on the corresponding control input, thereby delivering the pilot pressures A, B, C, D in accordance with the respective control inputs. The control lever unit 63 comprises arm pilot valves 63*a*, 63*b*, swing pilot valves 63*c*, 63*d*, and a common control lever 63*e* which can be manipulated in any of four crucial directions for selectively operating those pilot valves. The pilot valves 63*a*, 63*b*; 63*c*, 63*d* are each operated depending on the amount by which the control lever 63*e* is manipulated in corresponding one of the four crucial directions, i.e., on the corresponding control input, thereby delivering the pilot pressures E, F, G, H in accordance with the respective control inputs.

Figure 3:
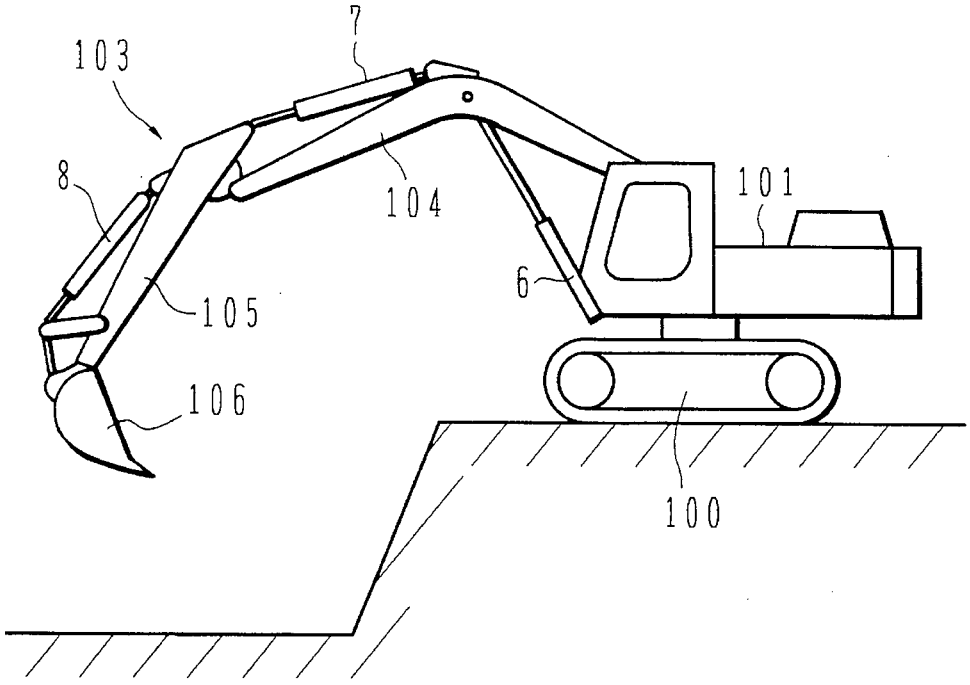
FIG. 3 is a side view of a hydraulic excavator on which the hydraulic drive system for use with the present invention is equipped.

The hydraulic excavator on which the above-described hydraulic drive system is equipped comprises, as shown in FIG. 3, an undercarriage 100, an upper structure 101 and a front attachment 103 for working. The front attachment 103 for working comprises a boom 104, an arm 105 and a bucket 106. The boom 104 is angularly moved in the vertical direction by the boom cylinder 6, the arm 105 is angularly moved back and forth by the arm cylinder 7, the bucket 106 is angularly moved back and forth as well as in the vertical direction by the bucket cylinder 8, and the upper structure 101 is swung by the swing motor 9.

In the hydraulic excavator, preferable driving speeds of the hydraulic actuators 6 to 9 are different one by one. More specifically, it is desired for the boom cylinder 6 to have a large maximum driving speed to achieve high working efficiency. Since the swing motor 9 is of great inertia and poses a difficulty in precisely stopping the same at the intended position, it desirably has a small maximum driving speed. Since the bucket cylinder 8 is of small size and frequently strikes against the stroke end when driven, it desirably has a small maximum driving speed in order to prevent shocks, deterioration in durability, useless pressure relief, etc. Further, the arm cylinder 7 is of smaller size than the boom cylinder 6 and suffers the similar problem to that of the bucket cylinder, but it is closely related to operation of the boom cylinder in many cases during the work. Therefore, the arm cylinder 7 desirably has a large maximum driving speed as with the boom cylinder 6.

A hydraulic pump control system of this embodiment is employed for use with the hydraulic drive system described above. The hydraulic pump control system of this embodiment comprises a regulator 19 for controlling the tilting amount of the swash plate 1*a* of the hydraulic pump 1 (i.e., the displacement volume of the hydraulic pump 1), a fixed throttle 20 disposed downstream of the center bypass line 5 for generating a negative control pressure in the center bypass line 5, a pressure sensor 21 for detecting the negative control pressure generated in the center bypass line 5, a pressure sensor 22 for detecting the pilot pressure A acting on the boom-up side of the flow control valve 10, a pressure sensor 23 for detecting the pilot pressure E acting on the arm crowding side of the flow control valve 11, a controller 24 for receiving respective detected values $P_N$, $P_B$, $P_A$ of the pressure sensors 21, 22, 23, processing them in a predetermined manner and then outputting an electric signal (current), and a proportional solenoid valve 25 operated by the electric signal from the controller 24. A control pressure output from the proportional solenoid valve 25 is input to the regulator 19.

The regulator 19 is made up of a hydraulic cylinder 2 for tilting the swash plate 1*a*, a servo valve 3 for horsepower control, and a servo valve 4 for flow rate control. A delivery pressure of the hydraulic pump 1 acts on one end of the servo valve 3 for horsepower control to thereby control the tilting amount of the swash plate so that the pump delivery pressure will not exceed a limit value. The control pressure output from the proportional solenoid valve 25 acts on one end of the servo valve 4 for flow rate control to thereby control the tilting amount of the swash plate so that the pump delivery rate depending on the control pressure is obtained.

Figure 4:
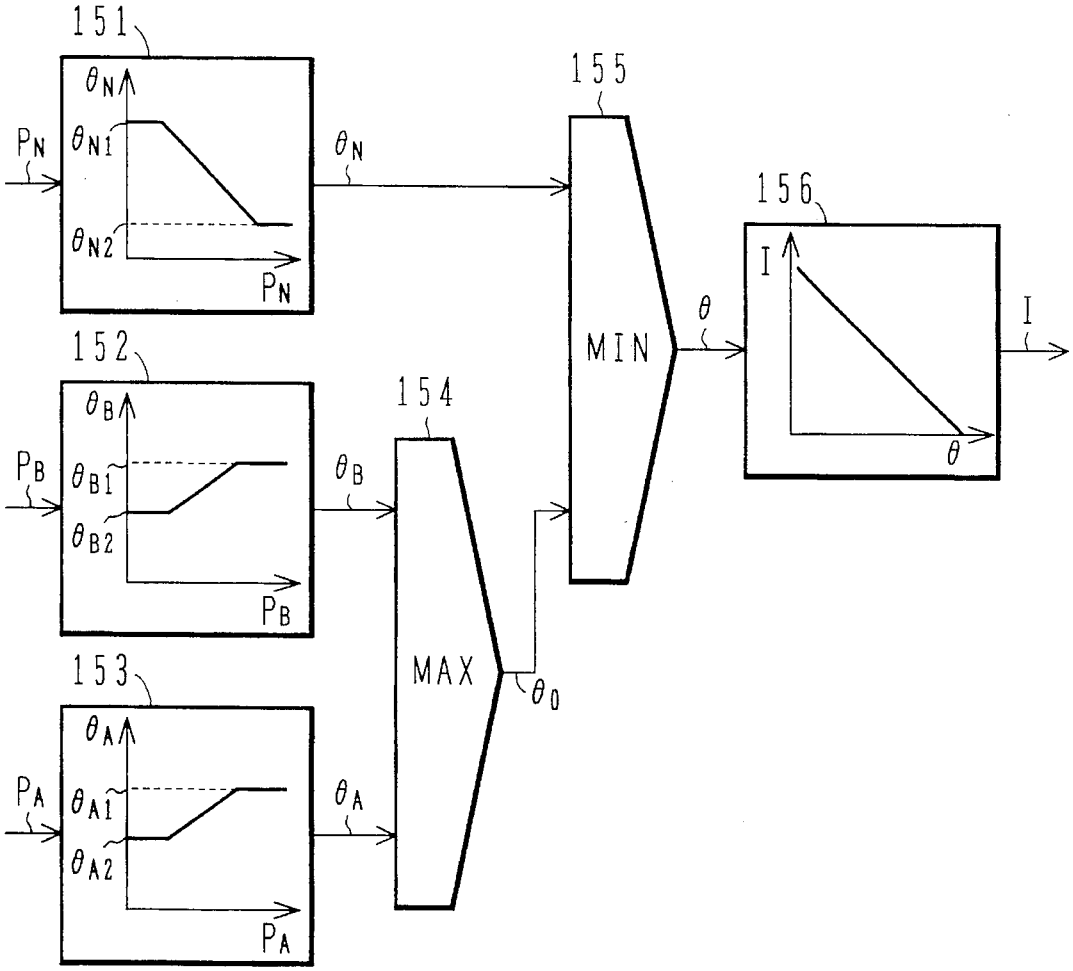
FIG. 4 is a block diagram for explaining functions of a controller shown in FIG. 1.
Figure 5:
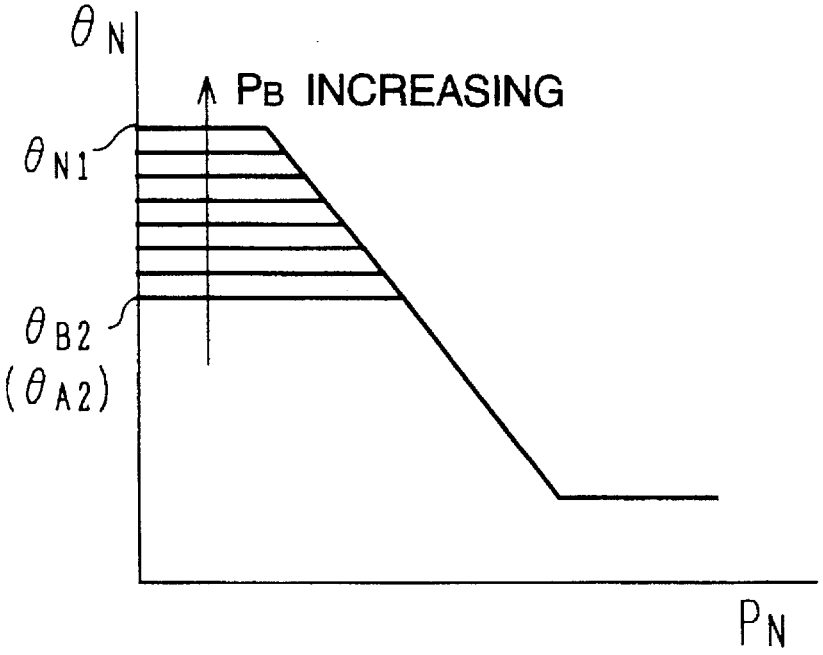
FIG. 5 is a graph for explaining the function of limiting a maximum value of the target tilting amount in the block diagram of FIG. 4.

FIG. 4 is a block diagram showing functions of the controller 24 shown in FIG. 1. The controller 24 includes a function generator 151 for calculating a target tilting amount (target displacement volume) $\theta_N$ corresponding to the detected value $P_N$ of the negative control pressure from the pressure sensor 21, a function generator 152 for calculating a target tilting amount $\theta_B$ corresponding to the detected value $P_B$ of the boom-up pilot pressure A from the pressure sensor 22, a function generator 153 for calculating a target tilting amount $\theta_A$ corresponding to the detected value $P_A$ of the arm crowding pilot pressure E from the pressure sensor 23, a maximum value selector 154 for selecting larger one of the target tilting amounts $\theta_B$ and $\theta_A$ and outputting the selected one as a target tilting amount $\theta_O$, a minimum value selector 155 for selecting smaller one of the target tilting amounts $\theta_N$ and $\theta_O$ and outputting the selected one as a target tilting amount θ, and a function generator 156 for calculating a current value I (a command value) corresponding to the target tilting amount θ. The current value I calculated by the function generator 156 is applied to a power supply unit (not shown) which in turn outputs an electric signal corresponding to the current value I to the proportional solenoid valve 25.

The function generator 151 has such a characteristic that it has a predetermined maximum value $\theta_{N1}$ and a predetermined minimum value $\theta_{N2}$, and as the detected value $P_N$ is reduced within a certain range of the detected value $P_N$, the tilting amount $\theta_N$ increases from the minimum value $\theta_{N2}$ to the maximum value $\theta_{N1}$ proportionally to the decrease in the detected value.

The function generator 152 has such a characteristic that it has a predetermined maximum value $\theta_{B1}$ and a predetermined minimum value $\theta_{B2}$, and as the detected value $P_B$ is increased within a certain range of the detected value $P_B$, the tilting amount $\theta_B$ increases from the minimum value $\theta_{B2}$ to the maximum value $\theta_{B1}$ proportionally to the increase in the detected value. Here, there hold relationships of $\theta_{B1}=\theta_{N1}$ and $\theta_{N2}<\theta_{B2}<\theta_{N1}$.

The function generator 153 has the same characteristic as that of the function generator 152, namely, its characteristic has a predetermined maximum value $\theta_{A1}$ $(=\theta_{B2})$ and a predetermined minimum value $\theta_{A2}$ $(=\theta_{B2})$, and as the detected value $P_A$ is increased within a certain range of the detected value $P_A$, the tilting amount $\theta_A$ increases from the minimum value $\theta_{A2}$ to the maximum value$\theta_{A1}$ proportionally to the increase in the detected value.

In the above arrangement, the function generators 152, 153, the maximum value selector 154 and the minimum value selector 155 jointly make up maximum target displacement volume limiting means for limiting, depending on the detected value $P_B$ or the detected value $P_A$ of the pressure sensor 22 or 23, the maximum value of the target tilting amount $\theta_N$ calculated by the function generator 151 based on the detected value $P_N$ of the pressure sensor 21, and providing the target tilting amount 0 to be output.

The operation of the hydraulic pump control system of this embodiment will now be described. First, when any of the control levers 63*e*, 63*e* is not manipulated and all the flow control valves 10 to 13 are in the neutral positions, the center bypasses of the flow control valves are all fully opened and a hydraulic fluid delivered from the hydraulic pump 1 is passed at a full flow rate through the center bypass line 5. Therefore, the negative control pressure generated by the fixed throttle 20 is maximized and the detected value $P_N$ of the pressure sensor 21 is also maximized. This maximum detected value $P_N$ of the pressure sensor 21 is input to the function generator 151 in the controller 24 where the maximum value $\theta_{N1}$ is calculated as the target tilting amount $\theta_N$.

Also, when all the flow control valves 10 to 13 are in the neutral positions, the pilot pressures A, E are not produced and the detected values $P_B$, $P_A$ of the pressure sensors 22, 23 are output as 0. The detected values $P_B$, $P_A$ are applied respectively to the function generators 152, 153 in the controller 24 where the minimum values$\theta_{B2}$, $\theta_{A2}$ $(=\theta_{B2})$ are calculated as the target tilting amounts $\theta_B$, $\theta_A$. Then, the maximum value selector 154 selects one of $\theta_{B2}$ and $\theta_{A2}$, e.g., $\theta_{B2}$, as the target tilting amount $\theta_O$.

Since there holds the relationship of $\theta_{N2}<\theta_{B2}<\theta_{N1}$ as described above, the minimum value selector 155 selects $\theta_{N2}$ as the target tilting amount θ to be output and issues an electric signal corresponding to$\theta_{N2}$ to the proportional solenoid valve 25. Accordingly, the swash plate 1*a* of the hydraulic pump 1 is tilted to the minimum target tilting amount $\theta_{N2}$, and the hydraulic pump 1 is kept at the minimum delivery rate.

Next, when the operator manipulates the control lever 62*e* solely over its full stroke in the direction of extending the boom cylinder 6, the flow control valve 10 is shifted to the left in FIG. 1 and the center bypass of the flow control valve 10 is restricted to reduce the flow rate passing through the center bypass line 15. The negative control pressure generated by the fixed throttle 20 and the detected value $P_N$ of the pressure sensor 21 are reduced as the amount by which the control lever 62*e* is manipulated, i.e., the control input, increases. The detected value $P_N$ of the pressure sensor 21 is applied to the function generator 151 in the controller 24, whereupon the target tilting amount $\theta_N$ calculated by the function generator 151 is changed from the minimum value $\theta_{N2}$ to the maximum value $\theta_{N1}$.

Simultaneously, the pilot pressure A acting in the direction of extending the boom cylinder is detected by the pressure sensor 22 which outputs the detected value $P_B$. The detected value $P_B$ is applied to the function generator 152 in the controller 24 where the calculated target tilting amount $\theta_B$ is increased as the control input from the control lever 62*e* increases, and the maximum target tilting amount $\theta_{B1}$ is finally calculated. In this case, because the control lever 63*e* is not manipulated in the direction of extending the arm cylinder 7, the target tilting amount $\theta_A$ calculated by the function generator 153 is the minimum value $\theta_{A2}$ $(<\theta_{B1})$. Therefore, the maximum value selector 154 selects $\theta_{B1}$ as the target tilting amount $\theta_O$.

Since there holds the relationship of $\theta_{B1}=\theta_{N1}$ as described above, the minimum value selector 155 selects one of $\theta_{B1}$ and $\theta_{N1}$, e.g., $\theta_{N1}$, as the target tilting amount to be output and issues an electric signal corresponding $\theta_{N1}$ to the proportional solenoid valve 25. Accordingly, the swash plate 1*a* of the hydraulic pump 1 is tilted to the maximum target tilting amount $\theta_{N1}$ and the delivery rate of the hydraulic pump 1 is maximized, enabling the boom cylinder 6 to be driven at a sufficiently high speed.

Also, when the operator manipulates the control lever 63*e* solely over its full stroke in the direction of extending the arm cylinder 7, the swash plate 1*a* of the hydraulic pump 1 is tilted to the maximum target tilting amount $\theta_{N1}$ and the delivery rate of the hydraulic pump 1 is maximized in a like manner as described above, enabling the arm cylinder 7 to be driven at a sufficiently high speed.

When the operator manipulates the control lever 63*e* solely in the direction of driving the swing motor 9, the flow control valve 13 is shifted to the left, for example, in FIG. 1 and the center bypass of the flow control valve 13 is restricted to reduce the flow rate passing through the center bypass line 15. The negative control pressure generated by the fixed throttle 20 and the detected value $P_N$ of the pressure sensor 21 are reduced as the amount by which the control lever 63*e* is manipulated, i.e., the control input, increases. The detected value $P_N$ of the pressure sensor 21 is applied to the function generator 151 in the controller 24 where the target tilting amount $\theta_N$ increasing proportionally to the control input from the control lever 63*e* is calculated.

In this case, because neither the control lever 62*e* is manipulated in the direction of extending the boom cylinder 6, nor the control lever 63*e* is manipulated in the direction of extending the arm cylinder 7, the function generators 152, 153 calculate respectively the minimum values $\theta_{B2}$, $\theta_{A2}$ $(\theta_{B2}=\theta_{A2})$ as the target tilting amounts $\theta_B$, $\theta_A$. Then, the maximum value selector 154 selects one of$\theta_{B2}$ and $\theta_{A2}$, e.g., $\theta_{B2}$, as the target tilting amount $\theta_O$. Accordingly, when the target tilting amount $\theta_N$ calculated by the function generator 151 halfway the stroke of the control lever 63*e* is smaller than $\theta_{B2}$ ($\theta_N<\theta_{B2}$), the minimum value selector 155 selects $\theta_N$ as the target tilting amount θ. On the other hand, when the control input from the control lever 63*e* is increased to such an extent that the target tilting amount $\theta_N$ calculated by the function generator 151 increases to satisfy a relationship of $\theta_N>\theta_{B2}$, the minimum value selector 155 selects $\theta_{B2}$ as the target tilting amount θ. Stated otherwise, the minimum value selector 155 provides the target tilting amount θ to be output which is resulted by limiting, depending on the detected value $P_B$ or $P_A$ of the pressure sensor 22 or 23, the maximum value of the target tilting amount $\theta_N$ calculated by the function generator 151 based on the detected value $P_N$ of the pressure sensor 21.

The swash plate 1*a* of the hydraulic pump 1 is tilted to the target tilting amount $\theta_N$ or $\theta_{B2}$ thus obtained from the minimum selector 155, and the delivery rate of the hydraulic pump 1 is controlled so as not to exceed the value corresponding to $\theta_{B2}$. Consequently, even when the operator manipulates the control lever 63*e* over its full stroke in the direction of swinging the upper structure, the speed of the swing motor 9 is surely suppressed and prevented from exceeding the limit value.

Also, when the operator manipulates the control lever 62*e* solely in the direction of driving the bucket cylinder 8, the delivery rate of the hydraulic pump 1 is controlled so as not to exceed the value corresponding to $\theta_{B2}$ in a like manner as in the above case. Therefore, even when the operator manipulates the control lever 63*e* over its full stroke, the speed of the bucket cylinder 8 is surely suppressed and prevented from exceeding the limit value.

Next, when the operator manipulates simultaneously the control lever 62*e* in the direction of extending the boom cylinder 6 and the control lever 63*e* in the direction of driving the swing motor 9, the negative control pressure and the pilot pressure for operating the boom are generated, whereupon the function generators 151, 152 calculate respectively the tilting amounts θN, $\theta_B$ corresponding to the detected values $P_N$, $P_B$ of the pressure sensors 21, 22. In this case, with the control lever 62*e* manipulated over its full stroke in the direction of extending the boom cylinder 6, the function generators 151, 152 finally calculate the same maximum target tilting amount $\theta_{N1}$ ($=\theta_{B1}$). Then, the maximum value selector 154 selects $\theta_{B1}$ as the target tilting amount $\theta_O$, and the minimum value selector 155 selects one of $\theta_{N1}$ and $\theta_{B1}$, e.g., $\theta_{N1}$, as the target tilting amount θ. Correspondingly, the swash plate 1*a* is controlled so as to have the maximum tilting amount. At this time, while the delivery rate of the hydraulic pump 1 is maximized, this maximum delivery rate is distributed to both the boom cylinder 6 and the swing motor 9, and hence the swing motor 9 is prevented from operating at an excessive speed.

Also, when the operator manipulates simultaneously the control lever 63*e* in the direction of extending the arm cylinder 7 and the control lever 62*e* in the direction of driving the bucket cylinder 8, the delivery rate of the hydraulic pump 1 is maximized in a like manner as in the above case, but this maximum delivery rate is distributed to both the arm cylinder 7 and the bucket cylinder 8, and hence the bucket cylinder 8 is prevented from operating at an excessive speed.

With this embodiment, therefore, the swing motor 9 and the bucket cylinder 8 which are each desired to have a small maximum driving speed can be surely suppressed in speed. It is thus possible to avoid inaccuracy in the stopped position of the swing motor 9, deterioration in durability of the swing motor itself and speed reducing gears, undue noise, etc. which would be otherwise caused by the excessive speed of the swing motor 9. Also, it is possible to avoid shocks, useless pressure relief, deterioration in durability of the bucket cylinder 8, etc. which would be otherwise caused by the bucket cylinder striking against the stroke end. Further, since the function generators 152, 153 have characteristics changing continuously, the delivery rate of the hydraulic pump varies smoothly and the hydraulic actuators are prevented from abruptly changing in speed.

A second embodiment of the present invention will be described below with reference to FIGS. 6. In operation of hydraulic excavators, it is demanded to drive the arm 105 at a low speed when the arm is horizontally pushed forward for the leveling work. This embodiment is intended to add a function to meet such a demand. In the figures, identical members and functions to those in FIGS. 1 and 4 are denoted by the same reference numerals.

Figure 6:
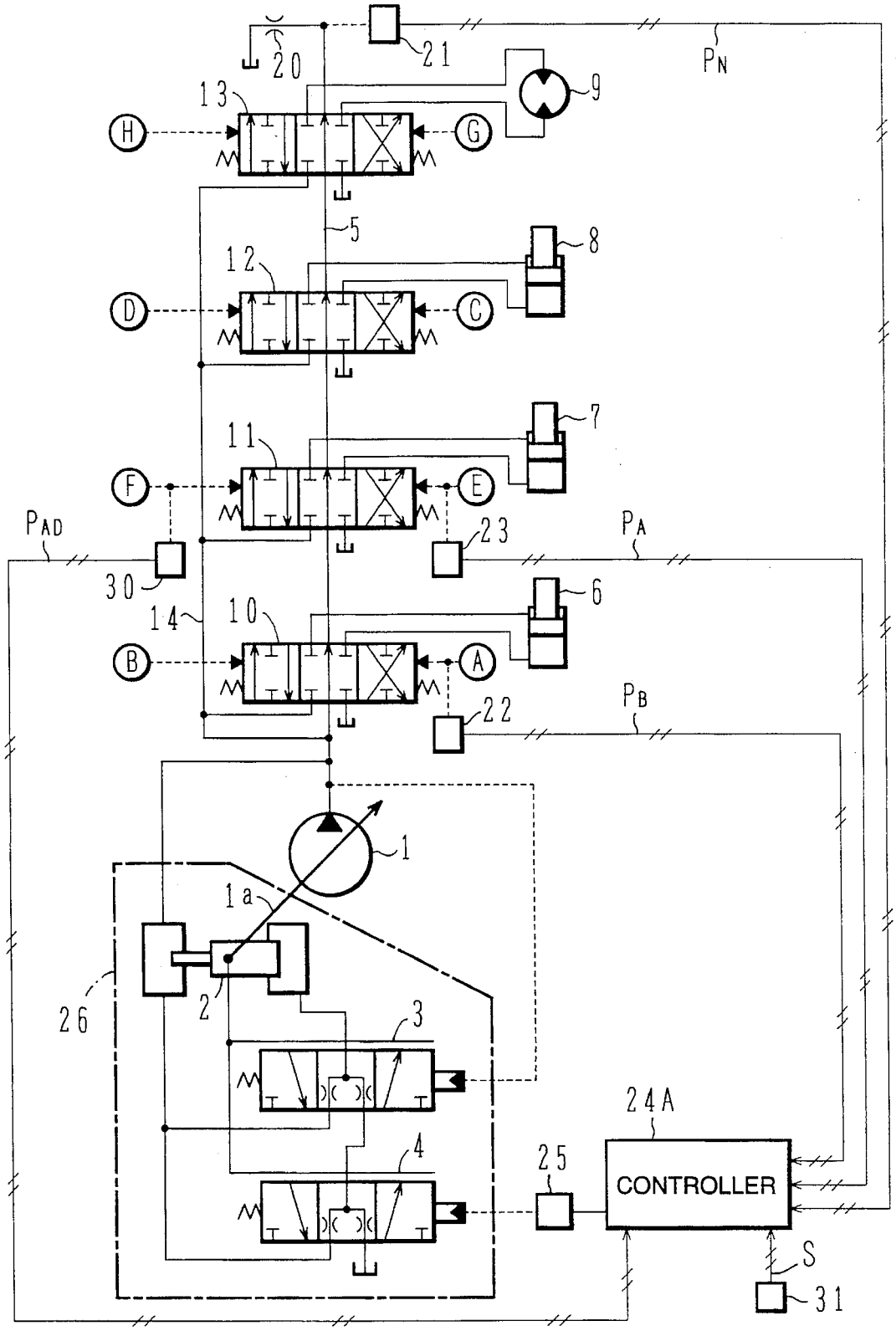
FIG. 6 is a hydraulic circuit diagram of a hydraulic pump control system for a hydraulic drive system according to a second embodiment of the present invention.

In FIG. 6, the hydraulic pump control system of this embodiment comprises, in addition to the components of the above-described system of the first embodiment, a pressure sensor 30 for detecting the pilot pressure F that acts on the arm dumping side of the flow control valve 11, and a selection switch 31 to be depressed by the operator when carrying out the leveling work. A controller 24A receives, in addition to the detected values $P_N$, $P_B$, $P_A$ of the pressure sensors 21, 22, 23, a detected value $P_{AD}$ of the pressure sensor 30 and a selection signal S from the selection switch 31, processing them in a predetermined manner and then outputting an electric signal (current) to the proportional solenoid valve 25.

Figure 7:
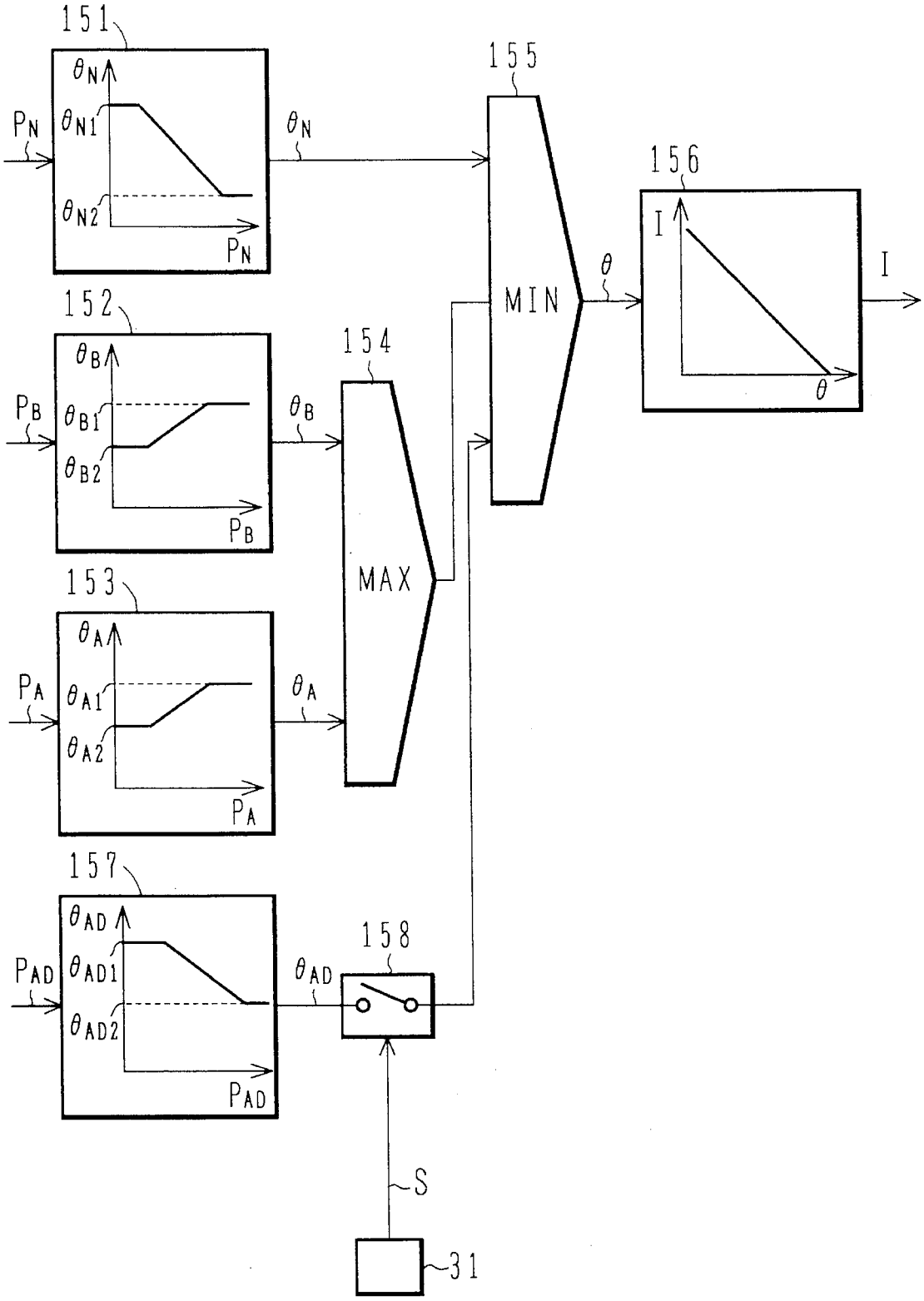
FIG. 7 is a block diagram for explaining functions of a controller shown in FIG. 6.

As seen from FIG. 7, the controller 24A includes, in addition to the functions shown in FIG. 4 for the controller of the first embodiment, a function generator 157 for calculating a target tilting amount $\theta_{AD}$ corresponding to the detected value $P_{AD}$ of the arm dumping pilot pressure F from the pressure sensor 30, and a selector 158 for inhibiting the target tilting amount $\theta_{AD}$ calculated by the function generator 157 from being output when the selection switch 31 is not depressed and the selection signal S is turned off, and allowing the target tilting amount $\theta_{AD}$ calculated by the function generator 157 to be output when the selection switch 31 is depressed and the selection signal S is turned on. The target tilting amount $\theta_{AD}$ output from the selector 158 is sent to the minimum value selector 155.

As shown, the function generator 157 has such a characteristic that it has a predetermined maximum value $\theta_{AD1}$ and a predetermined minimum value $\theta_{AD2}$, and as the detected value $P_{AD}$ is increased within a certain range of the detected value $P_B$, the tilting amount $\theta_{AD}$ reduces from the maximum value $\theta_{AD1}$ to the minimum value $\theta_{AD2}$ proportionally to the increase in the detected value. Here, there hold relationships of $\theta_{AD1}=\theta_{N1}$ and $\theta_{N2}<\theta_{AD2}<\theta_{N1}$.

When the selection switch 31 is not depressed in the above arrangement, the target tilting amount $\theta_{Ad}$ calculated by the function generator 157 is not output from the selector 158 and the system operates in a like manner as in the first embodiment.

When the selection switch 31 is depressed, the target tilting amount $\theta_{AD}$ calculated by the function generator 157 is output from the selector 158 to the minimum value selector 155. Therefore, even when the operator manipulates the control lever 63*e* to a large extent in the direction of contracting the arm cylinder 7 for pushing the arm forward horizontally with intent to carry out the leveling work by the combined operation of boom-up or boom-down and arm dumping of the hydraulic excavator, the function generator 157 calculates the minimum value $\theta_{AD2}$ ($<\theta_{N1}$) or a value thereabout as the target tilting amount $\theta_{AD}$. The minimum value selector 155 selects the minimum target tilting amount $\theta_{AD2}$ or the value thereabout as the target tilting amount $\theta$ and outputs an electric signal corresponding to $\theta_{AD2}$ or the value thereabout to the proportional solenoid valve 25. Accordingly, the swash plate 1*a* of the hydraulic pump 1 is tilted to $\theta_{AD2}$ or the value thereabout, and the delivery rate of the hydraulic pump 1 is controlled to a small value corresponding to $\theta_{AD2}$ or the value thereabout. As a result, the arm dumping speed is slowed to such an extent that the arm can be horizontally pushed forward with good fine operability.

When the operator manipulates the control lever 62*e* over its full stroke with intent to move up the boom solely, the function generator 151 calculates the maximum value $\theta_{N1}$ as the target tilting amount and the function generator 152 calculates the maximum value $\theta_{B1}$ ($=\theta_{N1}$) as with the first embodiment described above. On the other hand, since the control lever 63*e* is not manipulated in the direction of contracting the arm cylinder 7, the function generator 157 calculates the maximum value $\theta_{AD1}$ ($=\theta_{N1}$). Eventually, the minimum selector 155 selects the maximum value $\theta_{N1}$ as the target tilting amount. Therefore, the boom cylinder 6 can be driven at a high speed to quickly move up the boom without being restricted by the target tilting amount $\theta_{AD}$ calculated by the function generator 157.

While the above embodiments have been described in connection with the swing motor, the boom cylinder, the arm cylinder and the bucket cylinder of the hydraulic excavator, the present invention is also applicable to a track motor which is desired to have a large maximum driving speed. The present invention can be further applied to hydraulic actuators of working machines other than hydraulic excavators. While the above embodiments have been described as detecting the control inputs from the control levers through the pilot pressures, the control inputs may be detected in an electrical manner. The regulator may be of any type so long as it is operated in such a manner as able to precisely represent the target tilting amount obtained by the controller. In addition, it is apparent that the function generators, the maximum value selector and the minimum value selector can be constituted by using a microcomputer.

INDUSTRIAL APPLICABILITY

According to the present invention, as described above, it is possible to surely prevent an unwanted speed increase of a specific hydraulic actuator that would be caused when tilting amount control is carried out by using only the negative control pressure.

We claim:

1. A hydraulic pump control system for use with a hydraulic drive system comprising a variable displacement hydraulic pump (1), a plurality of hydraulic actuators (6–9) driven by said hydraulic pump, a plurality of flow control valves (10–13) of a center bypass type for controlling the driving of said hydraulic actuators, and a center bypass line (5) connecting the center bypasses of said flow control valves in series, said hydraulic pump control system controlling a displacement volume of said hydraulic pump by using a negative control pressure generated by flow resisting means (20) which is disposed downstream of said center bypass line, said hydraulic pump control system comprising:

pressure detecting means (21) for detecting the negative control pressure generated in said center bypass line (5), first target displacement volume calculating means (151) for calculating, based on a detected value of said pressure detecting means, a first target displacement volume of said hydraulic pump (1) in accordance with a preset first characteristic, first control input detecting means (22 or 23) for detecting a control input for operating at least one (6 or 7) of said plurality of hydraulic actuators, maximum target displacement volume limiting means (152–155) for limiting, depending on the detected value of said first control input detecting means, a maximum value of the first target displacement volume calculated by said first target displacement volume calculating means based on the detected value of said pressure detecting means, and providing a target displacement volume to be output, and a regulator (26) for controlling the displacement volume of said hydraulic pump in accordance with said target displacement volume to be output.

2. A hydraulic pump control system according to claim 1, wherein said maximum target displacement volume limiting means comprises second target displacement volume calculating means (152 or 153) for calculating, based on the detected value of said first control input detecting means (22 or 23), a second target displacement volume of said hydraulic pump (1) in accordance with a preset second characteristic different from said first characteristic, and smaller value selecting means (155) for selecting smaller one of said first and second target displacement volumes as said target displacement volume to be output.

3. A hydraulic pump control system according to claim 2, wherein said first characteristic is such that said first target displacement volume increases from a predetermined minimum value ($\theta_{N2}$) to a predetermined maximum value ($\theta_{N1}$) as the detected value of said pressure detecting means (21) is reduced, and said second characteristic is such that said second target displacement volume increases from a predetermined minimum value ($\theta_{B2}$ or $\theta_{A2}$) to a predetermined maximum value ($\theta_{B1}$ or $\theta_{A1}$) as the detected value of said first control input detecting means (22 or 23) is increased, the predetermined minimum value ($\theta_{B2}$ or $\theta_{A2}$) of said second characteristic being smaller than the predetermined maximum value ($\theta_{N1}$) of said first characteristic.

4. A hydraulic pump control system according to claim 3, wherein the predetermined maximum value ($\theta_{B1}$ or $\theta_{A1}$) of said second characteristic is equal to the predetermined maximum value ($\theta_{N1}$) of said first characteristic.

5. A hydraulic pump control system according to claim 2, further comprising second control input detecting means (30) for detecting a control input for operating other one (7) of said plurality of hydraulic actuators or a control input in a different direction from the control input for operating said at least one hydraulic actuator (7), wherein said maximum target displacement volume limiting means further comprises third target displacement volume calculating means (157) for calculating, based on the detected value of said second control input detecting means, a third target displacement volume of said hydraulic pump (1) in accordance with a preset third characteristic different from both said first and second characteristics, and said smaller value selecting means (155) selects a minimum value of said first, second and third target displacement volumes as said target displacement volume to be output.

6. A hydraulic pump control system according to claim 5, wherein said third characteristic is such that said third target displacement volume reduces from a predetermined maximum value (($\theta_{AD1}$) to a predetermined minimum value ($\theta_{AD2}$) as the detected value of said second control input detecting means is increased.

7. A hydraulic pump control system according to claim 1, wherein said at least one actuator is an actuator (6 or 7) of which desired maximum driving speed is relatively large.

8. A hydraulic pump control system according to claim 7, wherein said actuator of which desired maximum driving speed is relatively large is a boom cylinder (6) for operating a boom (104) of a hydraulic excavator.

9. A hydraulic pump control system according to claim 7, wherein said actuator of which desired maximum driving speed is relatively large is an arm cylinder (7) for operating an arm (105) of a hydraulic excavator.

* * * * *